United States Patent [19]

Wind

[11] 3,937,389

[45] Feb. 10, 1976

[54] DISPOSABLE FOOD CONTAINER

[76] Inventor: Harold Wind, c/o F-J Packaging Development Corporation, 80-103 Surrey Place, Jamaica, N.Y. 11432

[22] Filed: Oct. 9, 1973

[21] Appl. No.: 404,513

Related U.S. Application Data

[63] Continuation of Ser. No. 212,528, Dec. 27, 1971, abandoned, which is a continuation-in-part of Ser. No. 880,871, Nov. 28, 1969, abandoned.

[52] U.S. Cl. ..... 229/2.5 R; 150/.5; 206/72; 220/4 B; 220/4 E; 220/339; 229/44 R

[51] Int. Cl.[2] ... B65D 1/34; B65D 1/44; B65D 5/36; B65D 43/16

[58] Field of Search ..... 220/4 B, 4 E, 315, 70, 220/339; 229/2.5, 44 R; 150/.5; 206/72

[56] References Cited

UNITED STATES PATENTS

| | | | |
|---|---|---|---|
| 3,131,069 | 4/1964 | Goller | 206/45.34 |
| 3,151,799 | 9/1964 | Engles | 229/2.5 |
| 3,155,303 | 11/1964 | Fenkel | 229/2.5 |
| 3,266,655 | 8/1966 | Trunk | 220/4 E |
| 3,282,462 | 11/1966 | Box | 220/315 |
| 3,410,698 | 11/1968 | Sosin | 229/44 R |
| 3,436,231 | 4/1969 | Bruce | 229/2.5 |
| 3,511,433 | 5/1970 | Andrews | 220/315 |
| 3,519,189 | 9/1970 | Bambara | 229/44 R |

FOREIGN PATENTS OR APPLICATIONS

| | | | |
|---|---|---|---|
| 879,186 | 10/1961 | United Kingdom | 229/2.5 |

*Primary Examiner*—George E. Lowrance
*Attorney, Agent, or Firm*—Amster & Rothstein

[57] ABSTRACT

A molded single service food container adapted to permit eating the food directly from the container, comprising a formed tray portion generally wedge shaped having a planar top edge which is angularly disposed with respect to the bottom. A cover portion having substantially similar characteristics may be hinged to the tray by a continuous hinged member. Both tray and cover are preferably thermoformed plastic, either vacuum or pressure formed. The shallow end is provided with food elevating means to prevent food which overhangs the shallow end from contacting an unsanitary surface.

12 Claims, 24 Drawing Figures

INVENTOR.
HAROLD WIND

BY Stoll and Stoll

INVENTOR.
HAROLD WIND

BY Stel and Stel

INVENTOR.
HAROLD WIND

BY Stoll and Stoll

INVENTOR.
HAROLD WIND

BY

Stoll and Stoll

DISPOSABLE FOOD CONTAINER

This is a continuation of application Ser. No. 212,528, filed Dec. 27, 1971, now abandoned, which was a continuation- in-part of application Ser. No. 880,871, filed Nov. 28, 1969, now abandoned.

BACKGROUND OF THE INVENTION

1. Field of the Invention

Single service disposable carriers for convenience foods such as frankfurter and roll, hamburger and roll and slice of pizza.

2. Description of the Prior Art

The prior art contains many disposable food carriers which are largely cut and fluted waxed paper or pulp board trays. Corn on the cob may be served in aluminum or other metal foil and slices of pizza generally are served in food outlets on napkins or notoriously small sheets of waxed paper.

The general result of the prior art food holders is that they merely provide an inefficient bottom support for the food and do not provide protection or enclosure for the food. They are not adapted to receive printed information or advertising material, are usually inappropriate for storage or shipping of food and generally present a most unattractive and unwholesome environment for food sale and consumption.

SUMMARY OF THE INVENTION

Accordingly, the present invention provides a novel food container which combines in an economically feasible product the desirable qualities of cleanliness and drastically improved function.

Briefly, and not by way of limitation, the present invention comprises a formed plastic tray portion which is impervious to fluids, having a generally wedge-shaped appearance in which an upper edge is in a plane at an angle with respect to the bottom of the container. The sides of the container flare slightly outwardly in an upward direction. Various depressions may be formed in the bottom to receive and retain excess juices, strengthen the container and to raise the bottom of the container at the small end of the wedge to prevent excess length food from drooping over and touching an unsanitary surface. Further, food elevating means may be provided for the same purpose, such means comprising either a raised end shelf, raised ribs, or both.

A lid portion formed with substantially similar contours to the food tray may be placed thereon to enclose and protect the food. The lid may be separate or may be formed from the same material as the tray with an intermediate self hinge. In plan view the food tray is shaped to suit the food to be carried.

A thermoformed plastic having printable characteristics is desired. Either the tray or the lid portion may be transparent for food visibility and selection.

DESCRIPTION OF PREFERRED EMBODIMENTS OF THE INVENTION

Figure 1:
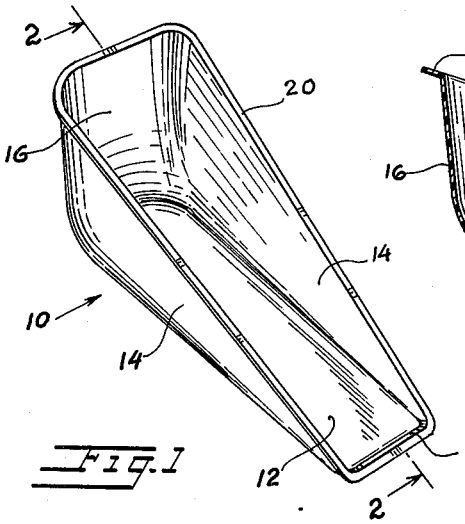
FIG. 1 is a perspective view of a food tray constructed in accordance with the teachings hereof. The general shape shown is a relatively long and narrow rectangle in plan view suitable for a frankfurter and roll.

Referring to the drawing, a first embodiment of the disposable food container of the present invention comprises a tray portion 10 which is formed in one piece having a bottom 12, substantially upright sides 14, a deep end wall 16 and a shallow end wall 18. All sides and bottom are formed with rounded or filled corners. A top edge 20 is the upper periphery of tray 10 and extends around the tray in a continuous unbroken manner.

It is an important feature of the present invention that top edge 20 is planar; that is, top edge 20 lies completely within the plane. It is another important feature of the invention that the plane in which top edge 20 lies is angularly disposed with respect to the plane of bottom 12 such that tray 10 is provided with a generally wedged shaped configuration. In this manner ends 16 and 18 are deep and shallow respectively.

Top edge 20 may be formed in a flange which flares from side walls 14 and end walls 16 and 18.

Figure 2:
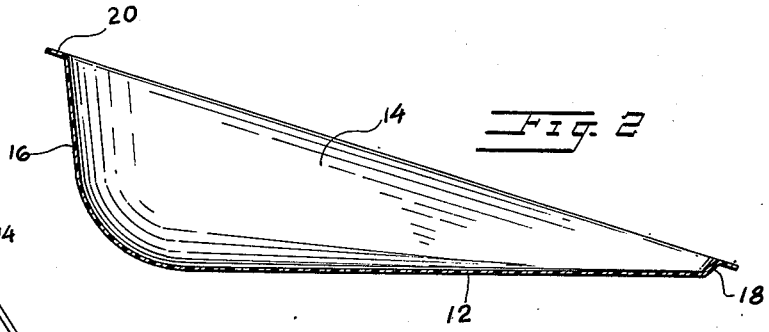
FIG. 2 is a cross-sectional view taken across line 2—2 of FIG. 1.
Figure 7:
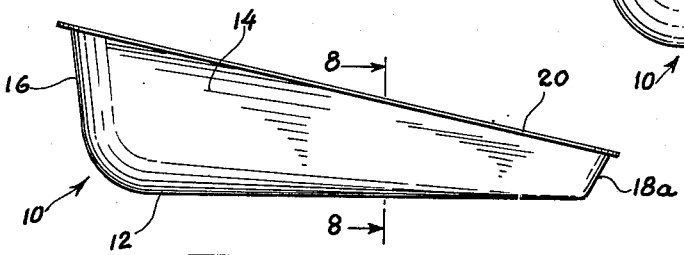
FIG. 7 is a side view of a food tray having a deeper forward end than that shown in FIG. 3.
Figure 4:
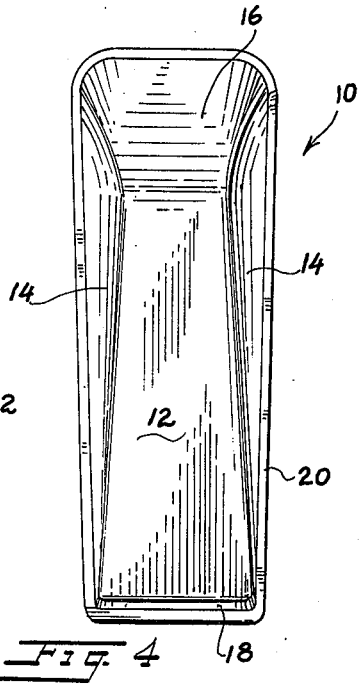
FIG. 4 is a bottom plan view of the food tray of FIG. 1.

It will be seen that food tray 10 as above described is particularly useful in connection with single service foods such as frankfurter in roll in that it provides the user with a hand grip at the deep end of the tray while exposing the food for eating at the shallow end thereof. If a frankfurter in roll is the intended food then the overall configuration shown in FIGS. 1, 2 and 4 would be particularly useful. The configuration provides a substantially rectangular shape in plan view. The wedge configuration yields another benefit, that being the ability of the tray to carry foods with a length greater than that of the tray, the excess length extending past shallow end 18 and overhanging the tray. Should, however, the overhang be excessive, a sanitary danger is posed, that being the resting of the food upon an unsanitary surface. The FIG. 7 embodiment having a slightly raised shallow end wall 18*a* would assist in solving that problem by raising the overhanging end of the food. An added benefit would be the retention of food juices without spilling.

Figure 3:
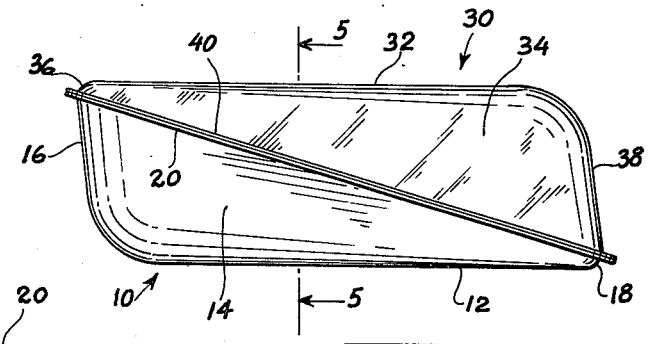
FIG. 3 is a side view of the food tray of FIG. 1 showing a lid mounted thereon.
Figure 5:
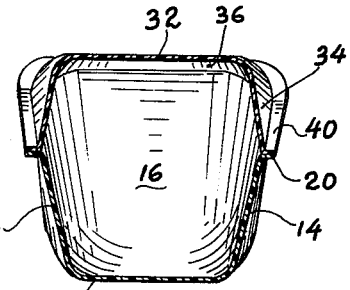
FIG. 5 is a cross-sectional view taken across line 5—5 of FIG. 3.
Figure 8:
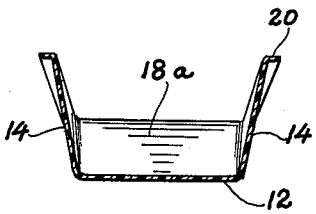
FIG. 8 is a cross-sectional view taken across line 8—8 of FIG. 7.
Figure 6:
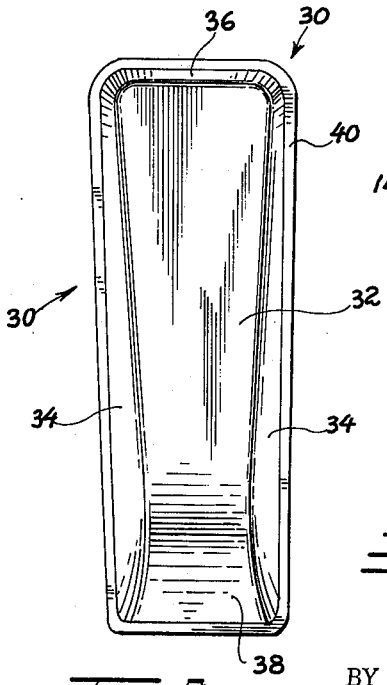
FIG. 6 is a bottom plan view of the lid shown in FIG. 3.
Figure 15:
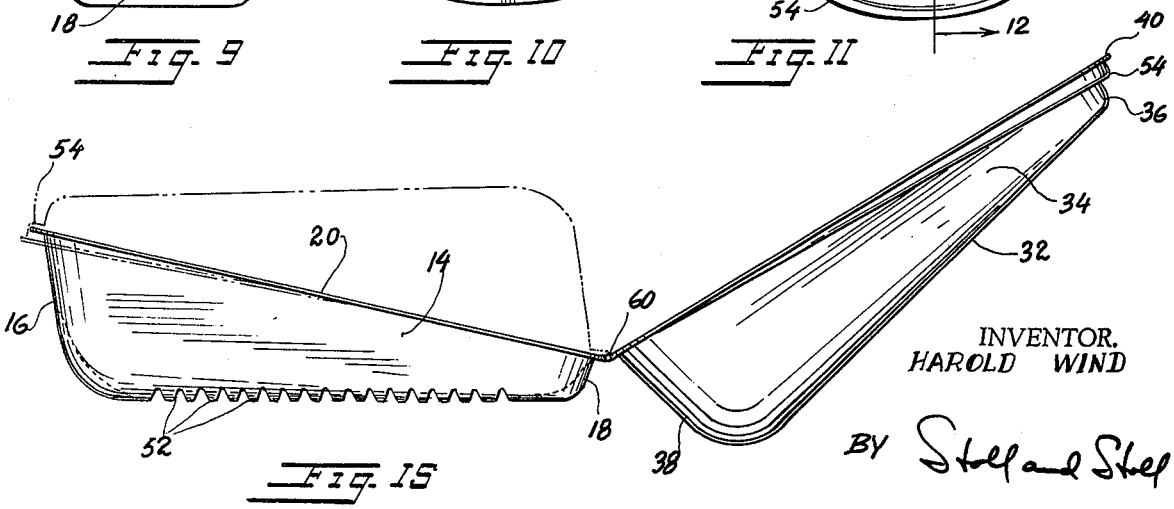
FIG. 15 is a view similar to that of FIG. 14 but showing the food tray and lid combination of FIG. 11.
Figure 16:
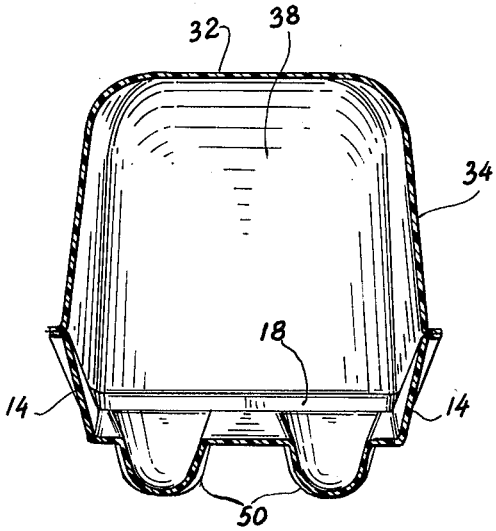
FIG. 16 is a cross-sectional view taken across line 16—16 of FIG. 13.

Improved preservation of the food, of its temperature, of its sanitation and of its appearance may be provided by the addition of a lid 30. Lid 30 would have a shape complementary to that of tray 10 in that the overall plan shape would be substantially the same as that of tray 10 to which it is to be matched, having a top 32 substantially similar in overall dimensions to bottom 12, sides 34 complementing tray sides 14, short end 36 complementing deep end 16 and long end 38 complementing shallow tray end 18. The circumferential bottom edge 40 of lid 30 would be substantially co-extensive in size and dimensions to top tray edge 20. Both edges 20 and 40 are planar and made to seal one against the other. It should be noted that in addition to the face-to-face juncture shown in FIGS. 3, 5 and 16, the lid may overlap the tray as shown in FIG. 15 and as will be more fully described hereinbelow.

Top 30 may be transparent to display the food contained and may be provided with suitable information, instructions or legend, as may be tray 10.

Tray bottom 12 may be substantially planar as shown in FIGS. 1–4 or may be provided with troughs or depressions 50 which are useful in retaining food juices and in inclining the plane of bottom 12 such that shallow end 18 is raised upon the plane of a table to prevent food extending over the shallow end from touching the table. Additionally, a plurality of ribs 52 may be formed in bottom 12 to provide rigidity to the bottom, to enhance its appearance, to increase friction and to retain food juices. Additionally, an insulating air barrier is formed between food and supporting surface which aids in food temperature retention.

Circumferential bottom edge 40 of lid 30 may additionally be provided with a formed rim 54 which encompasses top edge 20 of tray 10. Such a rim 54 would provide an improved seal between tray and lid. With rim 54, the lid would overlap the tray and could provide a friction fit.

Figure 9:
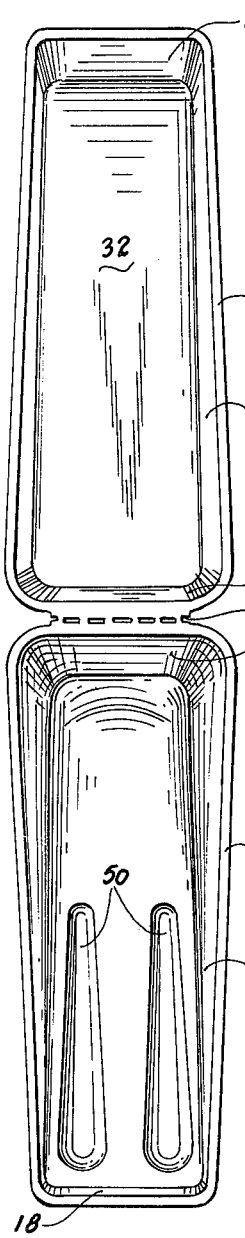
FIG. 9 is a top plan view of a modified form of the invention in which the tray and lid portions are integrally formed with an intermediate hinge. The view shows the lid opened and shows juice retaining troughs in the tray bottom.
Figure 10:
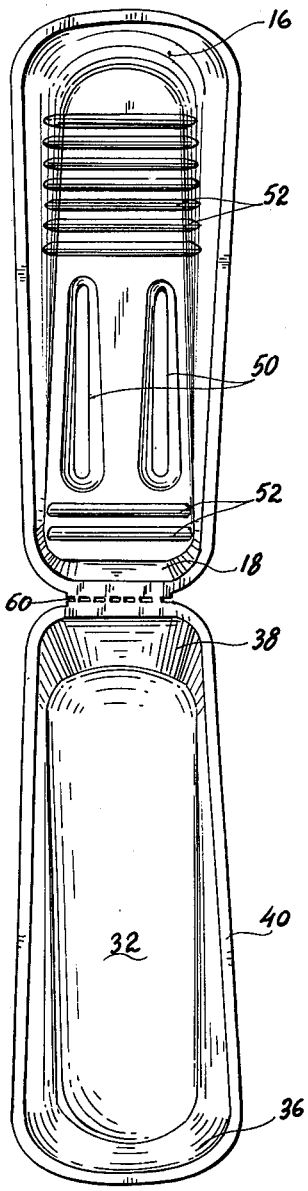
FIG. 10 is a view similar to that of FIG. 9 showing the hinge being located at the opposite and shallow end of the tray rather than the deep end as shown in FIG. 9. The tray bottom has alternative depression formations.
Figure 11:
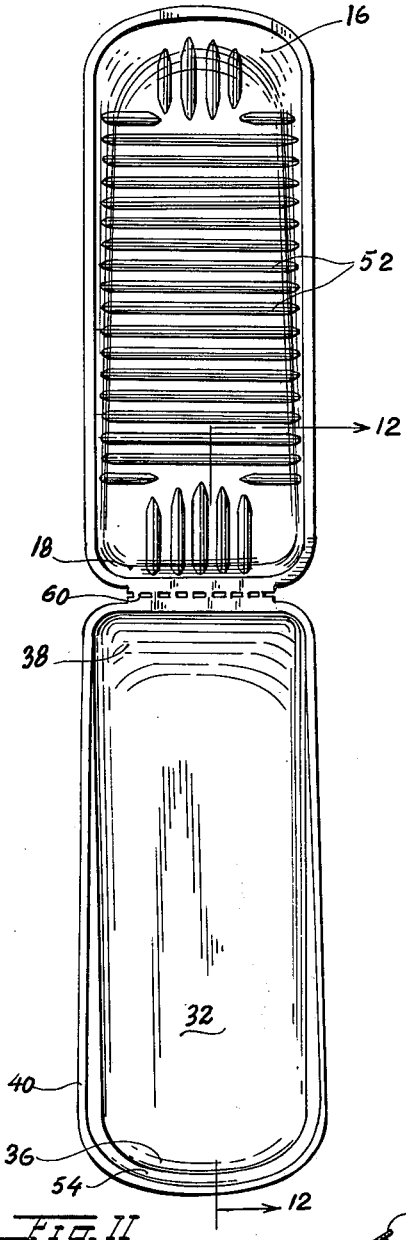
FIG. 11 is a view similar to that of FIG. 10 showing other alternative depression formations in the tray bottom.
Figure 12:
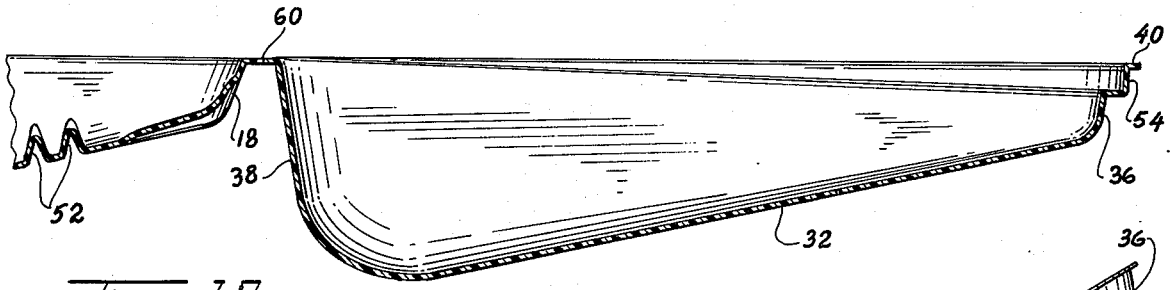
FIG. 12 is a cross-sectional view taken across line 12—12 of FIG. 11.
Figure 14:
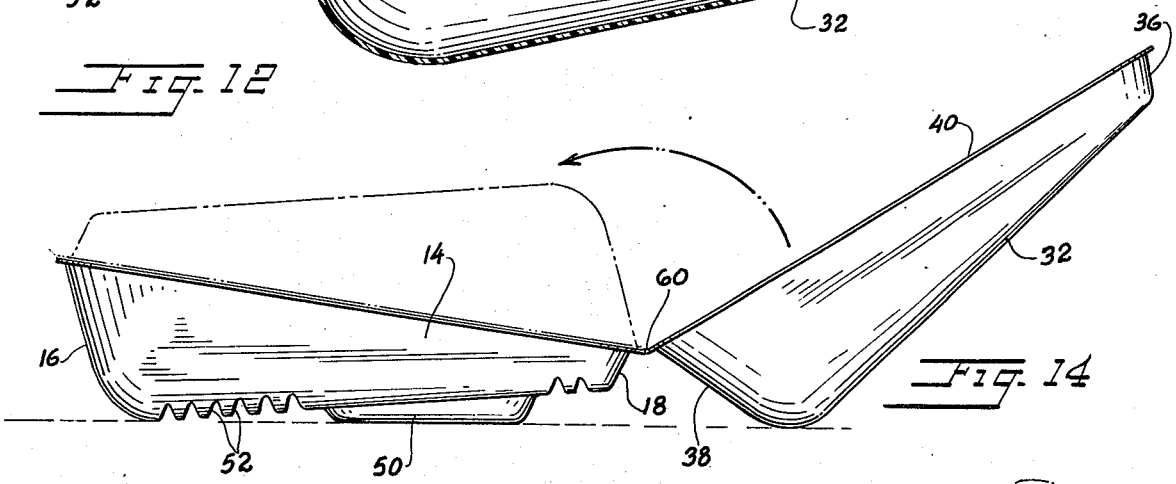
FIG. 14 is a view similar to that of FIG. 13 but illustrating the food tray and lid combination shown in FIG. 10.
Figure 13:
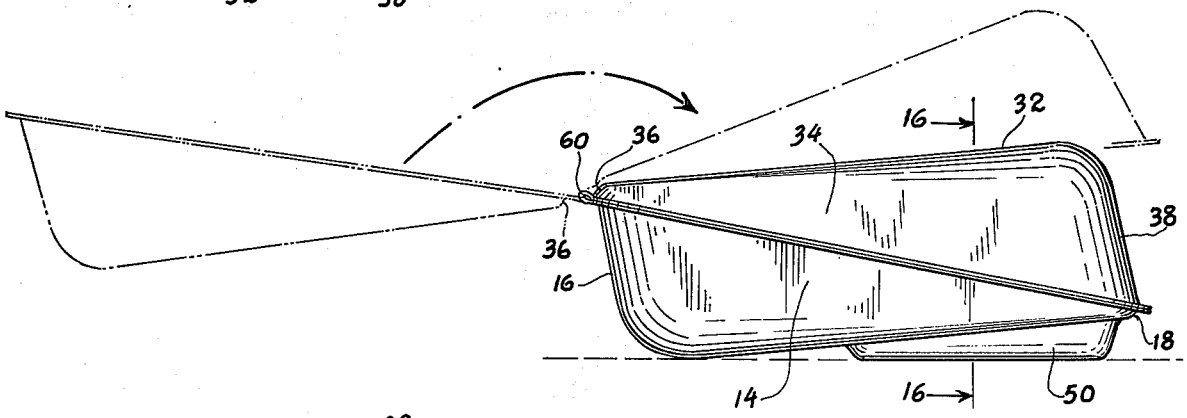
FIG. 13 is a side view of a food tray and lid combination similar to that shown in FIG. 9 with the hinge action of the lid being clearly illustrated.

As shown in FIGS. 3–6, lid 30 and tray 10 may be formed without connection and would be joined together by adhesives, adhesive tape, heat sealing or the like. An alternative method to join lid to tray is a hinge 60 joining between tray edge 20 and lid edge 40. Hinge 60 is preferably formed integrally with both tray and lid such that the tray and lid are a single continuous piece of material formed simultaneously. The most practical position for hinge 60 would be at an end of tray 10 and at an corresponding end of lid 30. Accordingly, as shown in FIGS. 9 and 13, deep tray end 16 is connected through hinge 60 to shallow lid end 36. In FIGS. 10 and 14, and again in FIGS. 11, 12 and 15, shallow tray end 18 is connected through hinge 60 to deep lid end 38. Hinge 60 when so formed may be made more flexible by being provided with a plurality of linear spaced perforations.

Figure 17:
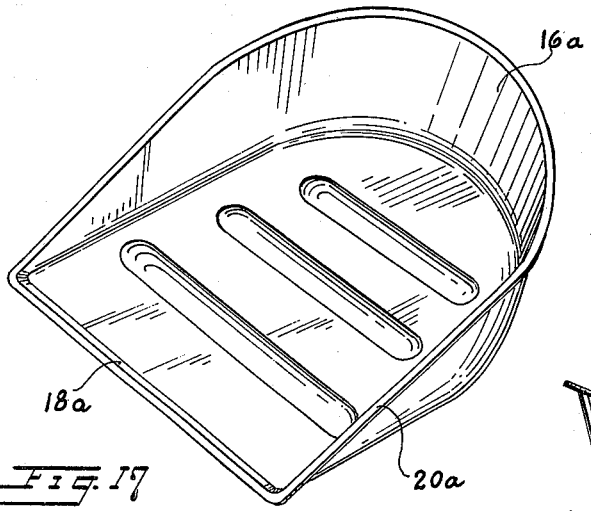
FIG. 17 is a perspective view of another form of the invention adapted for use with a hamburger and roll in which the food tray shown is generally wider than the food tray of FIG. 1 and has a substantially semi-circular deep end.
Figure 19:
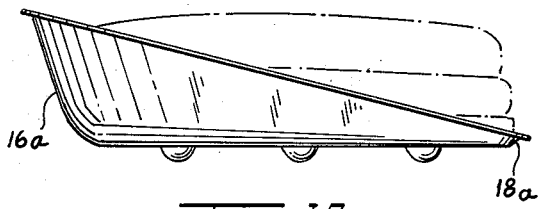
FIG. 19 is a side view of the food tray of FIG. 17 showing a normal hamburger and roll combination therein.
Figure 20:
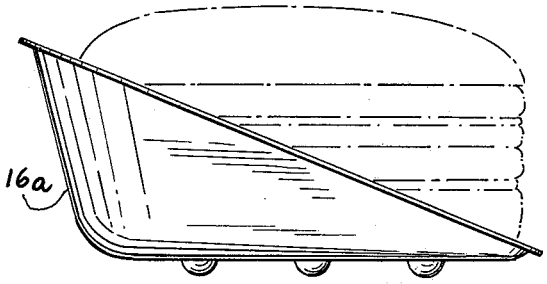
FIG. 20 is a view similar to that of FIG. 19 but showing a deeper tray for use with enlarged hamburger sandwiches.
Figure 18:
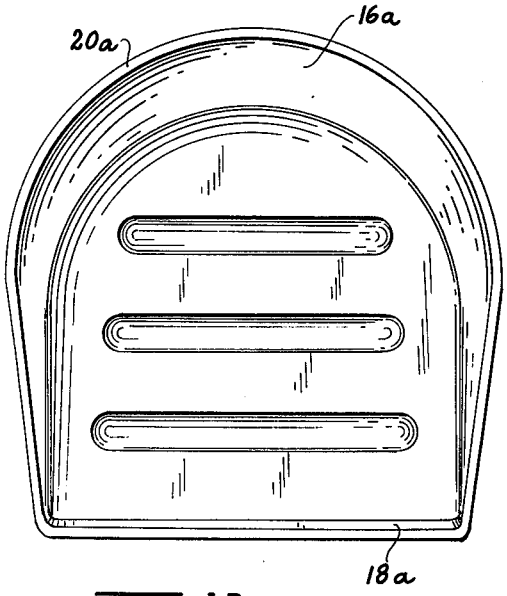
FIG. 18 is a top plan view of the food tray of FIG. 17.

To accommodate other common types of single service food, alternative shapes in plan view may be provided within the teachings of the invention. For example, in FIGS. 17–19, a wider, shallower shape is provided to accommodate a hamburger sandwich. The general wedge shape of the tray is retained as is planar top edge 20*a*. End 16*a* is generally semicircular and shallow end 18*a* is generally quite low to permit the hamburger sandwich to be easily withdrawn for eating. For particularly high hamburger sandwiches, deep end 16*a* may be increased in height to provide adequate protection for the contents as shown in FIG. 20.

Figure 21:
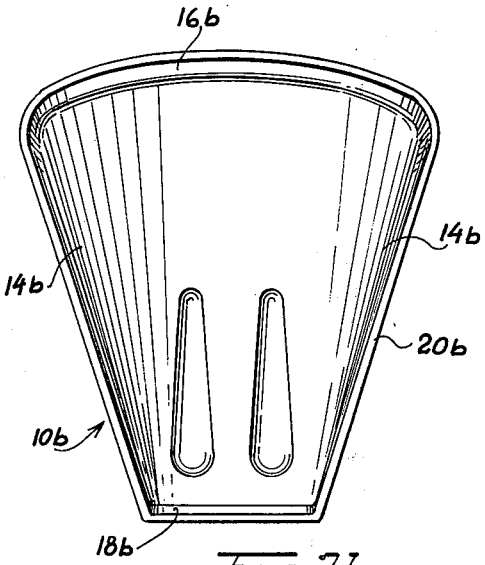
FIG. 21 is a top view of a further modified form of food tray adapted for use with a piece of pizza pie having a normal sector shape.
Figure 22:
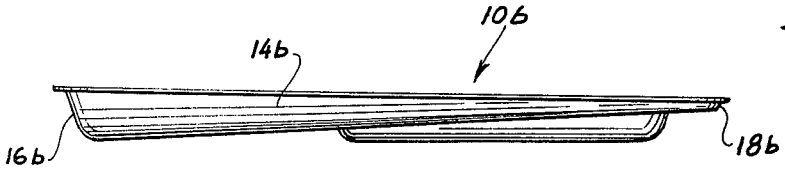
FIG. 22 is a side view of the food tray of FIG. 21.

A standard slice of pizza is a sector of a circle and is relatively flat. Food tray 10*b* as shown in FIGS. 21 and 22 is correspondingly flat with a low deep end 16*b* and even lower and shallower end 18*b*. The general overall shape in plan view approximates that of a sector of a circle but with an abridged narrow end. The abridged narrow end is shallow end wall 18*b* which is preferably straight. Sides 14*b* are flared sharply outwardly to permit the slice of pizza to slide toward shallow end 18*b*. Top edge 20*b* is planar and the overall appearance is wedge shaped.

Lid portions corresponding to the hamburger trays of FIGS. 17–20 or of the pizza tray of FIGS. 21–22 may be provided.

Figure 23:
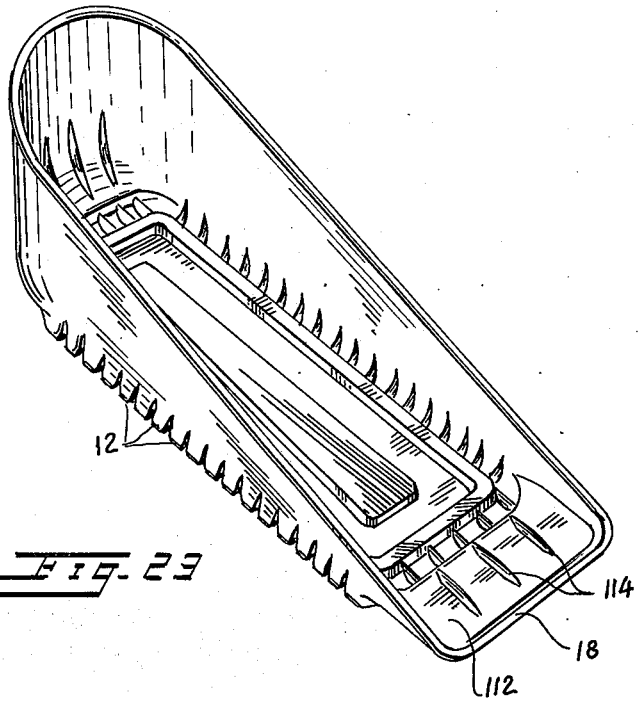
FIG. 23 is a perspective view of a further embodiment of the food tray having food elevating means.
Figure 24:
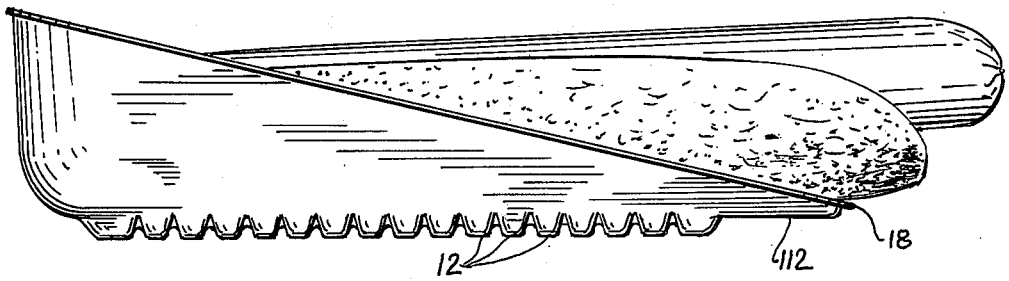
FIG. 24 is a front view of the embodiment shown in FIG. 23 showing a frankfurter and roll combination extending over the food elevating means.

It has been stated that the primary use of the food tray of the present invention is to provide a handhold so that food may be eaten directly from the tray. It has been noted that this usually contemplates that the food will extend a fair distance beyond the shallow end of the tray. An earlier version disclosed above provides downwardly extending depressions 50 to incline the plane of tray bottom 12 to help raise the food above a table surface. In FIGS. 23 et seq. there is shown an important modification for insuring that food does not touch an unsanitary surface.

Tray bottom 12 near shallow end 18 is provided with a raised section or step 112 which is elevated above the main portion of bottom 12 a distance sufficient to elevate overhanging food above an unsanitary tabletop. To assist in elevating the food, step 112 may be provided with raised ribs 114 which further elevate the food. It should be noted that raised ribs 114 are specifically designed not to collect and retain food juices as were depressions 50 of the earlier embodiment. In the present embodiment juices tend to run off raised ribs 114 and off step 112 in a direction away from shallow end 18, thereby providing an important benefit of this modification, namely, that the juices do not collect near the shallow end where they may spill onto an unwary user. Step 112 and raised ribs 114 individually and jointly comprise food elevating means.

Raised ribs 114 have two additional functions beyond elevating the food. First, they strengthen the shallow end of the food tray, this being important because that end is usually unsupported when the tray is held at the deeper end. Second, raised ribs 114 allow a degree of air circulation under the food at the shallow end of the tray thus cooling that portion of the food immediately before it is eaten, while the balance of the food at the deeper end of the tray is not so elevated and keeps its warmth.

Other modifications and embodiments may be had within the broad teachings hereof. For example, lid and tray may be joined together by a hinge between a side 14 of the tray and a side 34 of the lid. It will be noted that all embodiments hereof permit multiple trays, trays and lids, or lids to be easily stacked.

What is claimed is:

1. A food container comprising:

a. a tray having a tray bottom, a shallow end and a deep end opposite said shallow end; and a pair of opposed sides connecting between said ends; said ends and said sides being connected to and upstanding from said tray bottom; and b. one or more troughs in said tray bottom, said troughs being below said tray bottom and having a bottom surface defining a plane angularly disposed with respect to the plane of said tray bottom the angle of said disposition opening in a direction toward said shallow end of said tray, said troughs being deeper at said shallow end than at said deep end of said tray, said troughs raising said shallow end with respect to said deep end when said tray is placed on a planar surface.

2. A food container in accordance with claim 1 wherein said ends and said sides flare outwardly in an upward direction from said tray bottom.

3. A food container in accordance with claim 1 wherein said ends and said sides define a continuous top edge, and said continuous top edge defines a plane which is angularly disposed with respect to said tray bottom.

4. A food container in accordance with claim 1 wherein said tray bottom is provided with a plurality of ribs.

5. A food container according to claim 1 wherein said tray bottom is provided adjacent said shallow end with food elevating means.

6. A food container in accordance with claim 5 wherein said food elevating means comprises a raised step in said bottom adjacent said shallow end.

7. A food container in accordance with claim 5 wherein said food elevating means comprises raised ribs in said bottom adjacent said shallow end.

8. A food container in accordance with claim 5 wherein said food elevating means comprises a raised step in said bottom adjacent said shallow end, said step being provided with raised ribs.

9. A food container comprising:

a. a tray having a tray bottom, a shallow end and a deep end opposite said shallow end and a pair of opposed sides connecting between said ends; said ends and said sides being connected to and upstanding from said tray bottom; said ends and said sides flaring outwardly in an upward direction from said bottom; said ends and said sides defining a continuous top edge which defines a plane angularly disposed with respect to said tray bottom;

b. one or more troughs in said tray bottom, said troughs being below said tray bottom and having a bottom surface defining a plane angularly disposed with respect to the plane of said tray bottom the angle of said disposition opening in a direction toward said shallow end of said tray, said troughs being deeper at said shallow end than at said deep end;

c. said tray bottom being provided adjacent said shallow end with food elevating means sufficient to elevate the food extending past said shallow end above the plane of said tray bottom.

10. A food container in accordance with claim 9 wherein said food elevating means comprises a raised step in said bottom adjacent said shallow end.

11. A food container in accordance with claim 9 wherein said food elevating means comprises raised ribs in said bottom adjacent said shallow end.

12. A food container in accordance with claim 9 wherein said food elevating means comprises a raised step in said bottom adjacent said shallow end, said raised step being provided with raised ribs.

* * * * *